US007936234B2

(12) United States Patent
Wu et al.

(10) Patent No.: US 7,936,234 B2
(45) Date of Patent: May 3, 2011

(54) MARCHAND BALUN WITH AIR BRIDGE

(75) Inventors: Pei-Si Wu, Taipei (TW); Tian-Wei Huang, Taipei (TW); Huei Wang, Taipei (TW)

(73) Assignee: National Taiwan University, Taipei (TW)

( * ) Notice: Subject to any disclaimer, the term of this patent is extended or adjusted under 35 U.S.C. 154(b) by 482 days.

(21) Appl. No.: 12/207,508

(22) Filed: Sep. 10, 2008

(65) Prior Publication Data

US 2010/0045400 A1 Feb. 25, 2010

Related U.S. Application Data

(63) Continuation-in-part of application No. 11/422,884, filed on Jun. 8, 2006, now abandoned.

(51) Int. Cl.
*H01P 5/10* (2006.01)

(52) U.S. Cl. ..... 333/26

(58) Field of Classification Search ..... 333/4, 5, 333/25, 26, 33, 35, 128, 204, 205
See application file for complete search history.

(56) References Cited

U.S. PATENT DOCUMENTS 6,351,192 B1 * 2/2002 Sheen ..... 333/26

* cited by examiner

*Primary Examiner* — Benny Lee
*Assistant Examiner* — Gerald Stevens

(57) ABSTRACT

A microwave or millimeter-wave balun is provided. The balun uses three edge-coupled lines along with a plurality of air bridges instead of two edge-coupled lines used in a conventional planar Marchand balun. The first edge-coupled line and the second edge-coupled line are substantially parallel, and the third edge-coupled line is disposed also substantially in parallel between the first edge-coupled line and the second edge-coupled line. The plurality of air bridges are transmission lines between the first edge-coupled line and the second edge-coupled line. The air bridges have total width longer than one half of the total length of the first edge-coupled line or the second edge-coupled line. By combining three edge-coupled-lines and a plurality of air bridges, the Marchand balun has a higher coupling coefficient and increases the operation bandwidth. The microwave monolithic integrated circuit (MMIC) mixer based on the balun can provide compact size compared to conventional ones.

9 Claims, 9 Drawing Sheets

(a)

(b)

MARCHAND BALUN WITH AIR BRIDGE

CROSS REFERENCE

This is a continuation-in-part of U.S. application Ser. No. 11/422,884, filed Jun. 8, 2006 now abandoned, which is incorporated herewith by reference.

BACKGROUND OF THE INVENTION

1. Field of the Invention

The present invention generally relates to a balun, and more particularly to a Marchand balun that has a higher coupling coefficient and wider operation bandwidth. The microwave monolithic integrated circuit (MMIC) mixer based on the present invention can provide compact size compared to conventional ones and can be applied to more different types of systems.

2. The Prior Arts

A conventional balun is used between balanced transmission line and unbalanced transmission line to convert unbalanced signal to balanced signal, or balanced signal to unbalanced signal. Signal input into a balun from the unbalanced port would be converted by the balun to produce signals at the balanced ports of equal amplitude and 180 degree phase shift. A balun plays an important role in microwave and millimeter-wave systems, and can be applied to balanced amplifiers, mixers, voltage-controlled oscillators, phase shifters, and antennas, etc.

A balun can be made in different types of structure, such as active type, lumped component type, Marchand type, and Rat-race type structure. An active type balun has advantages of wide bandwidth and gain, but at the cost of larger noise and power dissipation. A lumped component balun has compact size by adopting lumped capacitors and lumped inductors but has smaller operation bandwidth. Therefore a lumped component balun is normally used in systems whose operation bandwidth is less than 10 GHz. On the other hand, a Rat-race balun contains three quarter-wave length transmission lines and one transmission ¾ wavelength line, while a Marchand balun contains two quarter-wave length coupled lines. The Marchand balun therefore has a more compact balun size.

The Marchand balun is extensively applied in microwave and millimeter-wave systems because of its wide operation bandwidth. Please refer to FIG. 1, which is a schematic view of a conventional Marchand balun.

As shown in FIG. 1, a Marchand balun 100 comprises a first edge-coupled-line set 102 containing two quarter-wave length coupled lines, and a second edge-coupled-line set 104 containing another two quarter-wave length coupled lines (R. Mongia, I. Bahl, and P. Bhartia, *RF and Microwave Coupled-Line Circuits*, Norwood, Mass.: Artech House, 1999, ch 11). When a signal at central frequency excites the balun 100 at the first port 110, balanced signals of equal amplitude and 180 degree phase shift are produced at the second and third ports 106 and 108. Due to its edge coupling, the Marchand balun 100 as shown in FIG. 1 would have leakage field and therefore result in less efficient electric field utilization.

FIG. 2 is a schematic view of another conventional Marchand balun disclosed by Basu. As shown in FIG. 2, the Marchand balun uses three edge-coupled lines and has wider operation bandwidth.

The Marchand balun 200 as shown in FIG. 2 contains two edge-coupled-line sets 204 and air bridges 202 (S. Basu, and S. A. Maas, "Design and performance of a planar star mixer," *IEEE Trans. on Microwave Theory and Techniques*, vol. 41, pp. 2028-2030, November 1993.). Each edge-coupled-line set 204 contains three coupled lines. Air bridges 202 are connected between two coupled lines in the edge-coupled-line sets 204 and therefore these two coupled lines have equal potential. The air bridges 202 are provided at the ends of the connected coupled lines, and the ratio of the total width of the air bridges 202 to the total length of coupled lines is no more than 10%.

FIG. 3 is a schematic view of another conventional Marchand balun disclosed by Kamozaki (T. N. Trinh, W. S. Wong, D. Li, and J. R. Kessler, "Ion implanted W-band monolithic balanced mixers for broadband applications," *Microwave and Millimeter-Wave Monolithic Circuits*, vol. 87, pp. 89-92, June 1987.). As shown in FIG. 3, the Marchand balun 300 contains two stacking coupled lines and is used for a 50-100 GHz mixer. The overlapping coupled lines of FIG. 3 and the three coupled lines of FIG. 2 are also of ¼ wavelength in length and therefore do not increase the size of Marchand balun compared to conventional Marchand baluns.

SUMMARY OF THE INVENTION

Accordingly, a Marchand balun with air bridges is provided herein. According to the present invention, the Marchand balun has higher coupling coefficient to increase bandwidth and solve the limitation of operating frequency in conventional Marchand balun.

The Marchand balun according to the present invention contains an edge-coupled-line set which has three coupled lines and a plurality of air bridges. The three coupled lines include a first coupled line, a second coupled line and a third coupled line. The third coupled line is for receiving and processing input signal. The first coupled line and the second coupled line are substantially parallel, and the third coupled line is disposed also substantially in parallel between the first coupled line and the second coupled line. The first and second coupled lines are both connected to ground. The plurality of air bridges are transmission lines between the first coupled line and the second coupled line, wherein the air bridges have total width longer than one half of the total length of the first coupled line or the second coupled line.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
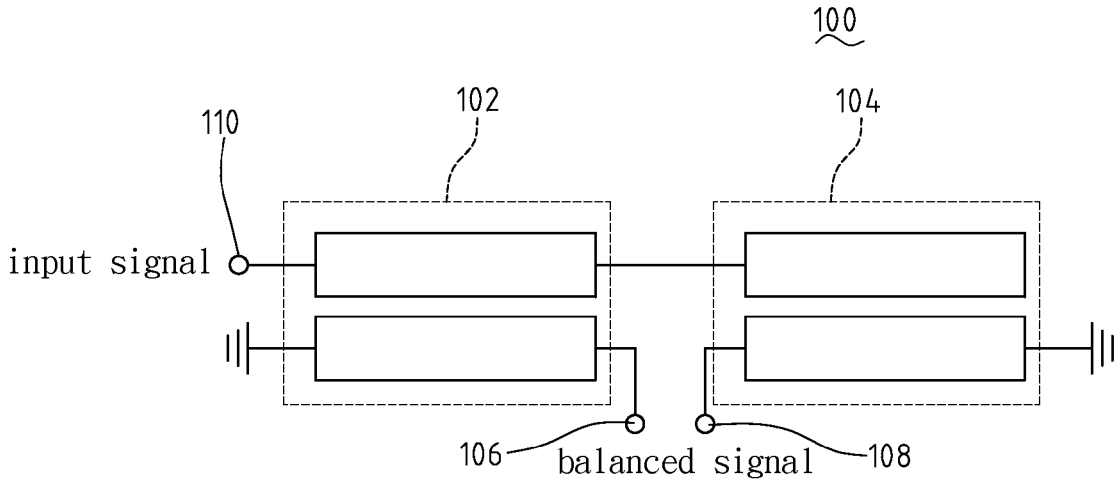
FIG. 1 (Prior Art)
FIG. 1 is a schematic view of a conventional Marchand balun.
Figure 2:
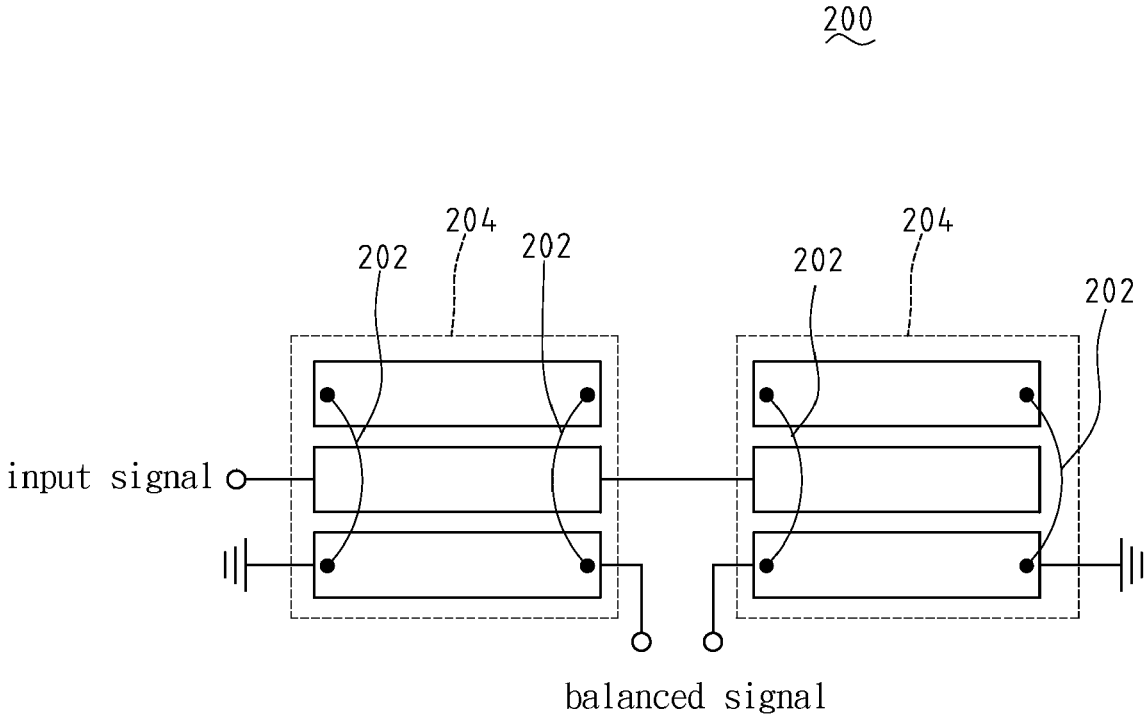
FIG. 2 (Prior Art)
FIG. 2 is a schematic view of another conventional Marchand balun.
Figure 3:
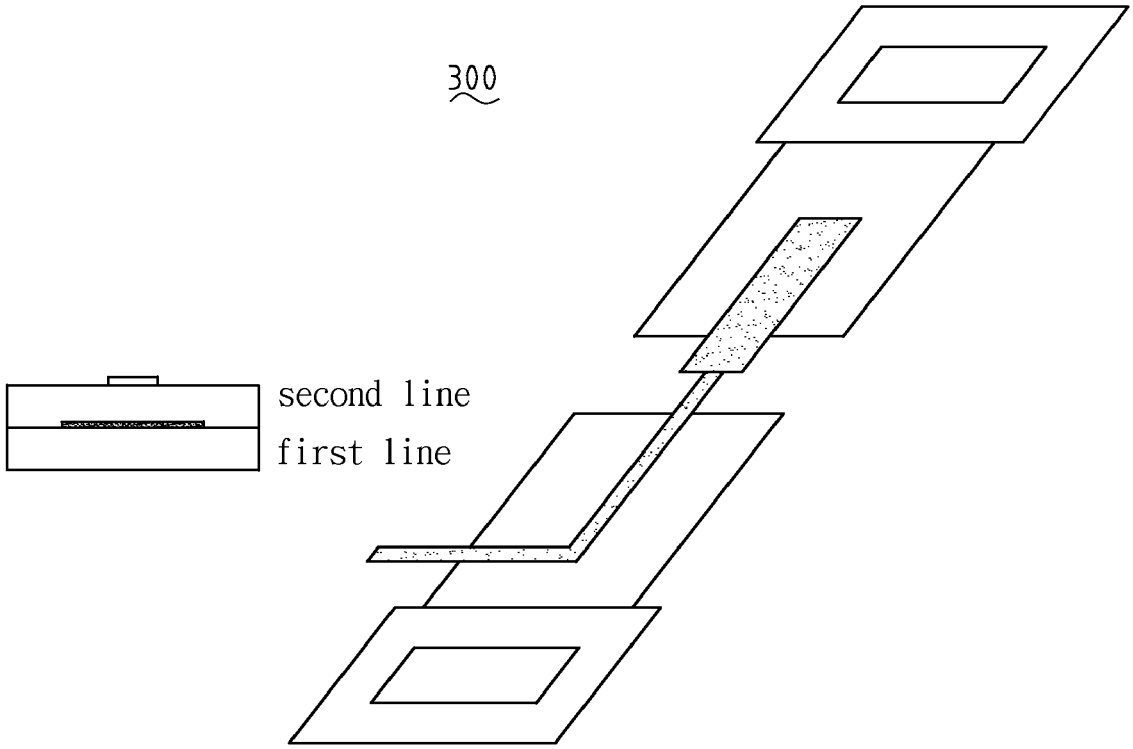
FIG. 3 (Prior Art)
FIG. 3 is a schematic view of another conventional Marchand balun.
Figure 4:
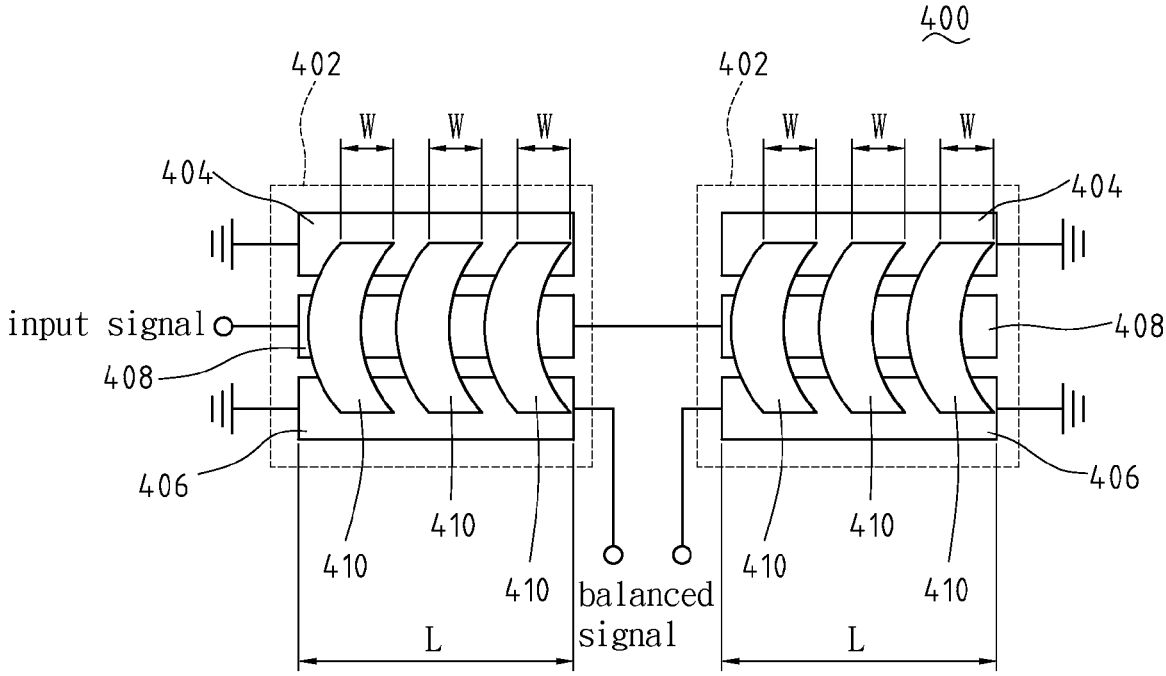
FIG. 4 is a schematic view of the Marchand balun according to the present invention.

FIG. 4 is a schematic top view of an embodiment of the Marchand balun according to the present invention. As shown in FIG. 4, the Marchand balun 400 contains two edge-coupled-line set 402 each having three coupled lines and a plurality of air bridges 410. Each edge-coupled-line set 402 contains a first coupled line 404, a second coupled line 406 and a third coupled line 408. The number of the air bridges 410 is a design parameter and can be different in different embodiments. For the present embodiment, six air bridges are adopted.

In the present embodiment as shown in FIG. 4, the third coupled line 408 is used for receiving and processing input signal.

In a preferred embodiment of the present invention, the third coupled line 408 can be, but is not limited to, a parallel edge-coupled line of ¼ wavelength in length.

The first coupled line 404 is disposed in parallel to a side of the third coupled line 408 and is electrically connected to ground. The first coupled line 404 is also a parallel edge-coupled line of ¼ wavelength in length.

The second coupled line 406 is disposed in parallel to the other side of the third coupled line 408 and is electrically connected to ground. The second coupled line 406 is also a parallel edge-coupled line of ¼ wavelength in length.

The first coupled line 404 and the second coupled line 406 are electrically coupled by the air bridges 410. As such, a balanced signal is provided from the second coupled line 406 from the processed input signal. As shown in FIG. 4, the width of each air bridge 410 is W and the length of the first or second coupled line is L. It is important to point out that in the preferred embodiment, the ratio of the total width of the air bridges 410 to the length of the first coupled line 404 or the second coupled line 406, i.e., (W+W+W)/L, is greater than 50% for achieving the desired benefit and performance.

In a preferred embodiment of the present invention, the air bridges 410 are made of a metallic material.

Figure 5:
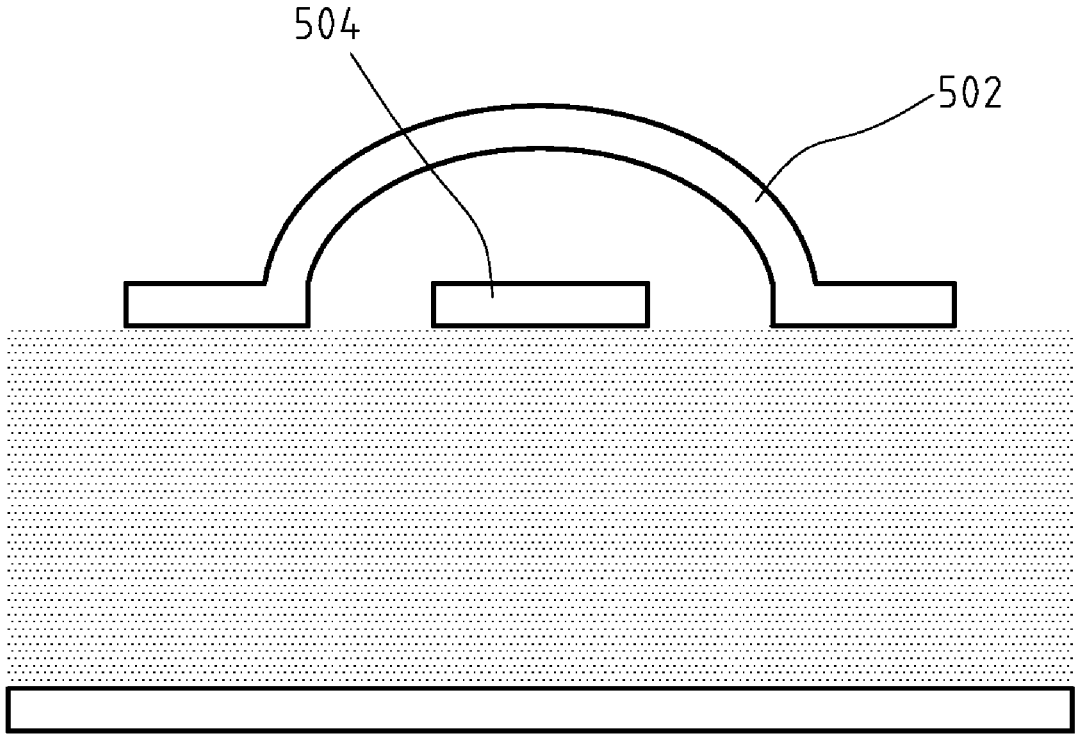
FIG. 5 is a cross-sectional view of the Marchand balun according to the present invention.

FIG. 5 is a cross-sectional view of the Marchand balun of FIG. 4. As shown in FIG. 5, the air bridge 502 (i.e., the air bridge 410 of FIG. 4) is disposed across a metal stub 504 (i.e., the third coupled line 408 of FIG. 4).

By the standard air bridge manufacturing process, the maximal width of the air bridge 502 is 20 μm. Therefore, a long air bridge can be replaced by a number of short air bridges 502. Moreover, the using of three edge-coupled lines, i.e. the first coupled line 404, the second coupled line 406, and the third coupled line 408, increases coupling coefficient and widens operation bandwidth of the Marchand balun 400 according to the present invention.

The Marchand balun with air bridges according to the present invention is preferred to contain two symmetric edge-coupled-line sets, each containing three edge-coupled lines.

By achieving wider operation bandwidth as described, the central frequency of the Marchand balun 400 according to the present invention can be increased so as to reduce the chip size.

In a preferred embodiment according to the present invention, the input signal is microwave or millimeter-wave signal.

In an embodiment according to the present invention, the air bridges can be integrated into a standard manufacturing process of monolithic microwave integrated circuit (MMIC) to produce a MMIC mixer. The MMIC mixer, under experiment, shows a high performance which suffers from less than 10 dB conversion loss for 50-78 GHz with a compact size as small as 0.57×0.52 $mm^2$, much smaller than conventional circuits.

To apply the microwave and millimeter wave baluns of the present invention, the microwave circuit (including MMIC) usually has a multi-layered structure.

Figure 6:
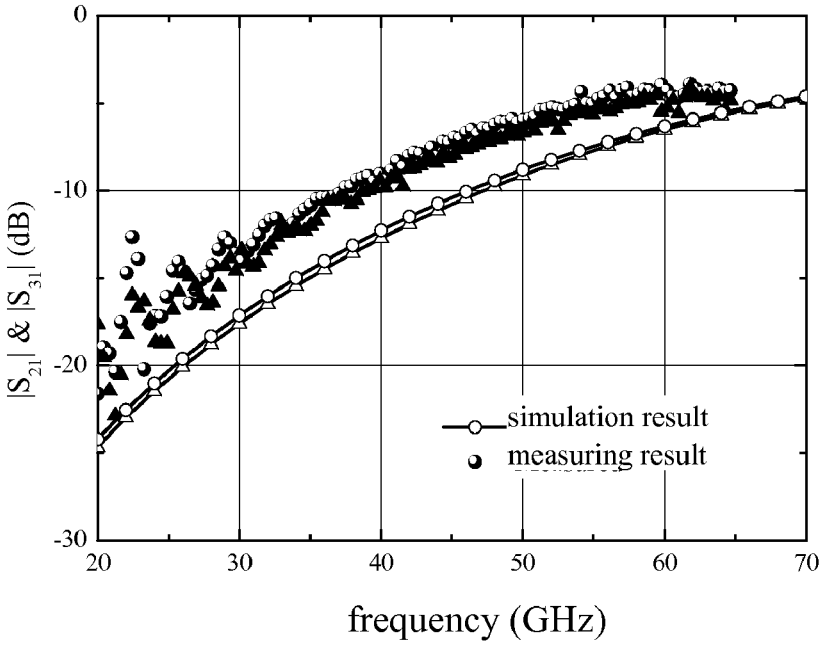
FIG. 6*a* is a curve diagram of simulation and measurement result of insertion loss in a preferred embodiment of the present invention.
FIG. 6*b* is a diagram showing difference in amplitude and in phase of balanced signals in a preferred embodiment of the present invention.
Figure 6:
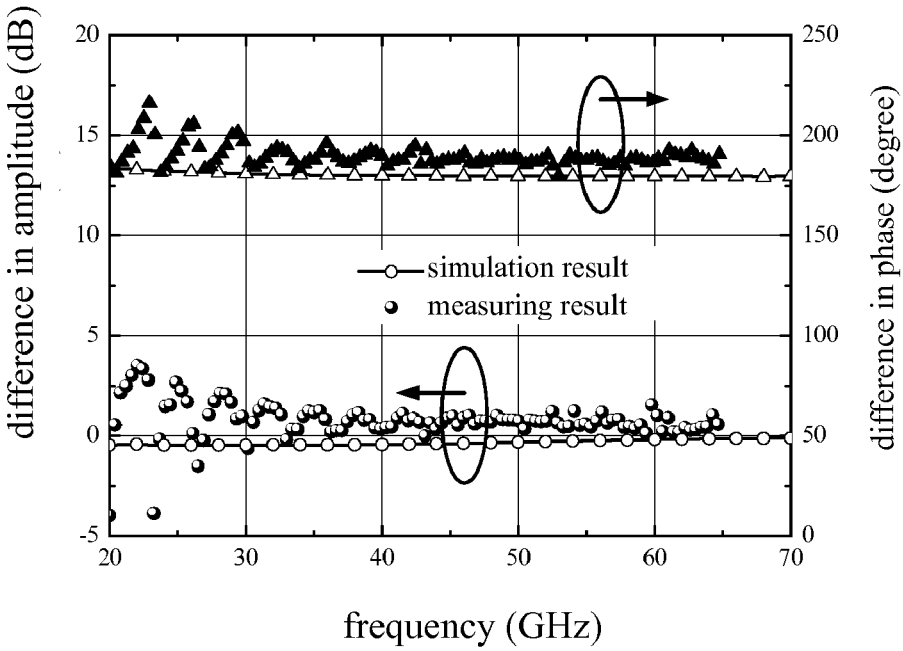

FIG. 6*a* and FIG. 6*b* are small signal data analysis diagrams measured by Anritsu 37397A vector analyzer at 65 GHz of an embodiment of the present invention. In the measurement, three-port S-parameters are extracted from two port measurements by a port reduction method. FIG. 6*a* shows the simulation and measurement curves of insertion loss according to the present invention. FIG. 6*b* shows the differences in amplitude and in phase of the balanced signals according to the present invention. As illustrated, the Marchand balun 400 has better performance at the amplitude difference 1 dB and phase difference 12 degree within 40-65 GHz band.

Spectrum analyzer and microwave power meter can also be used to measure the performance of a wideband MMIC mixer according to the present invention. The measurement is limited to 41-78 GHz due to the constraints of the W-band high-power source. For the mixer, the local oscillator (LO) is driven by signal generator with power amplifier. The radio frequency (RF) signal is provided by the Agilent 8510C network analyzer capable of millimeter scale measurement.

Figure 7:
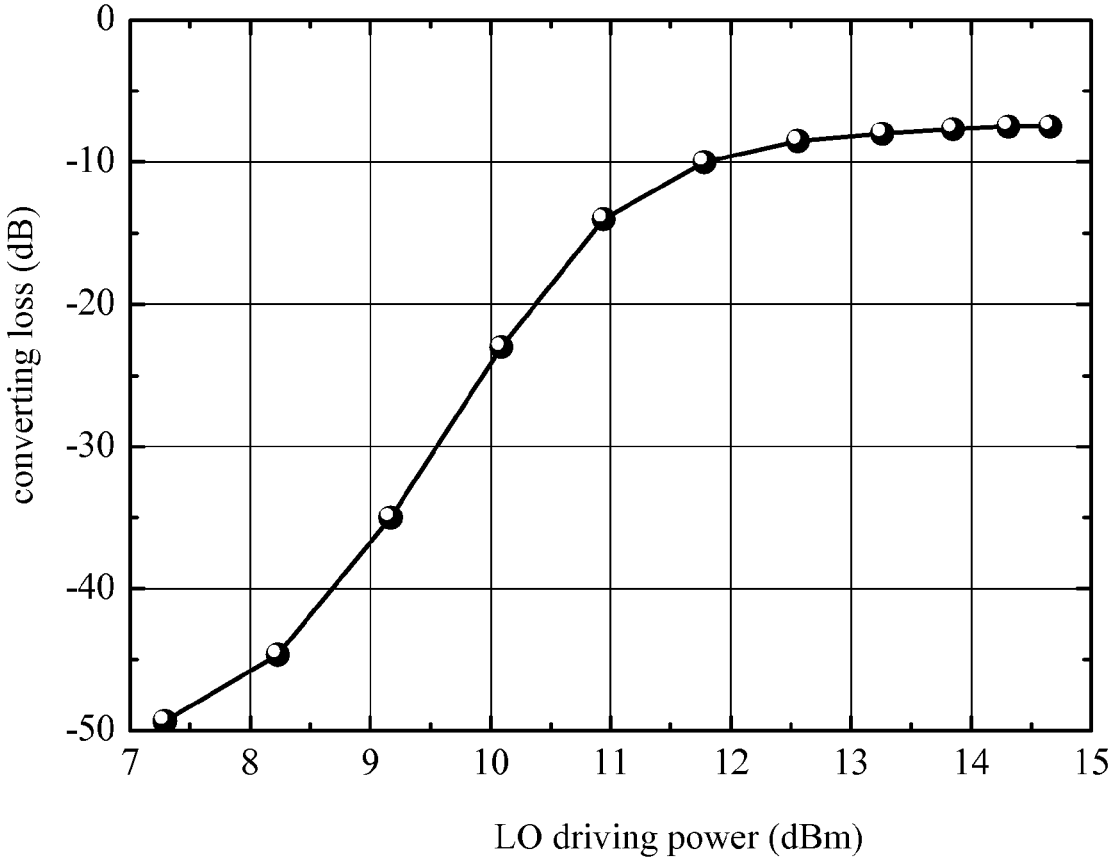
FIG. 7 is a curve diagram showing measured relationship between conversion loss and LO driving power in a preferred embodiment of the present invention.
Figure 8:
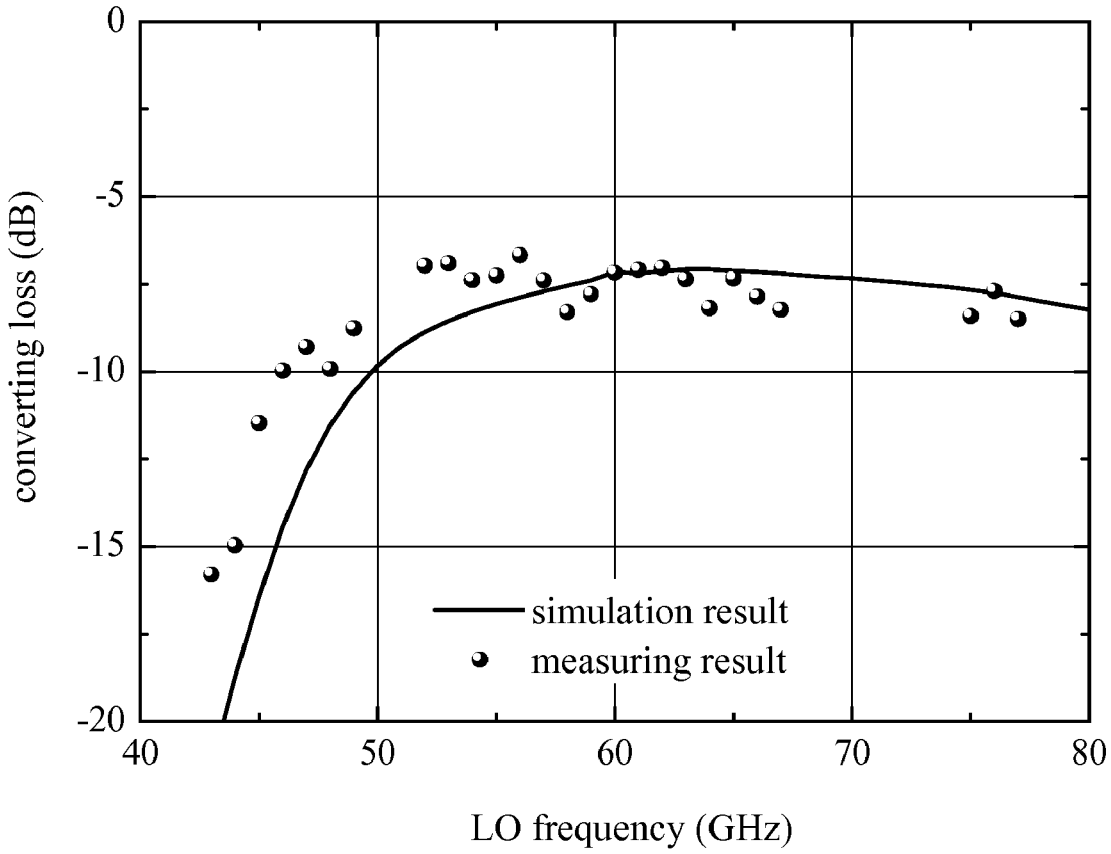
FIG. 8 is a curve diagram showing simulation and measurement result of conversion loss and LO operating frequency in a preferred embodiment of the present invention.

FIG. 7 is a diagram showing the measured relationship between the conversion loss and the LO driving power. As shown in FIG. 7, the conversion loss is greater than the LO driving power at 77 GHz, which means using 12.5 dBm LO power to drive the mixer is acceptable for achieving low power loss. FIG. 8 is a curve diagram showing the simulation and measurement result of conversion loss and LO frequency of an embodiment of the present invention. In the present invention, the mixer has 7-10 dB conversion loss when LO driving power is 12.5 dBm and the center frequency is fixed at 1 GHz.

Figure 9:
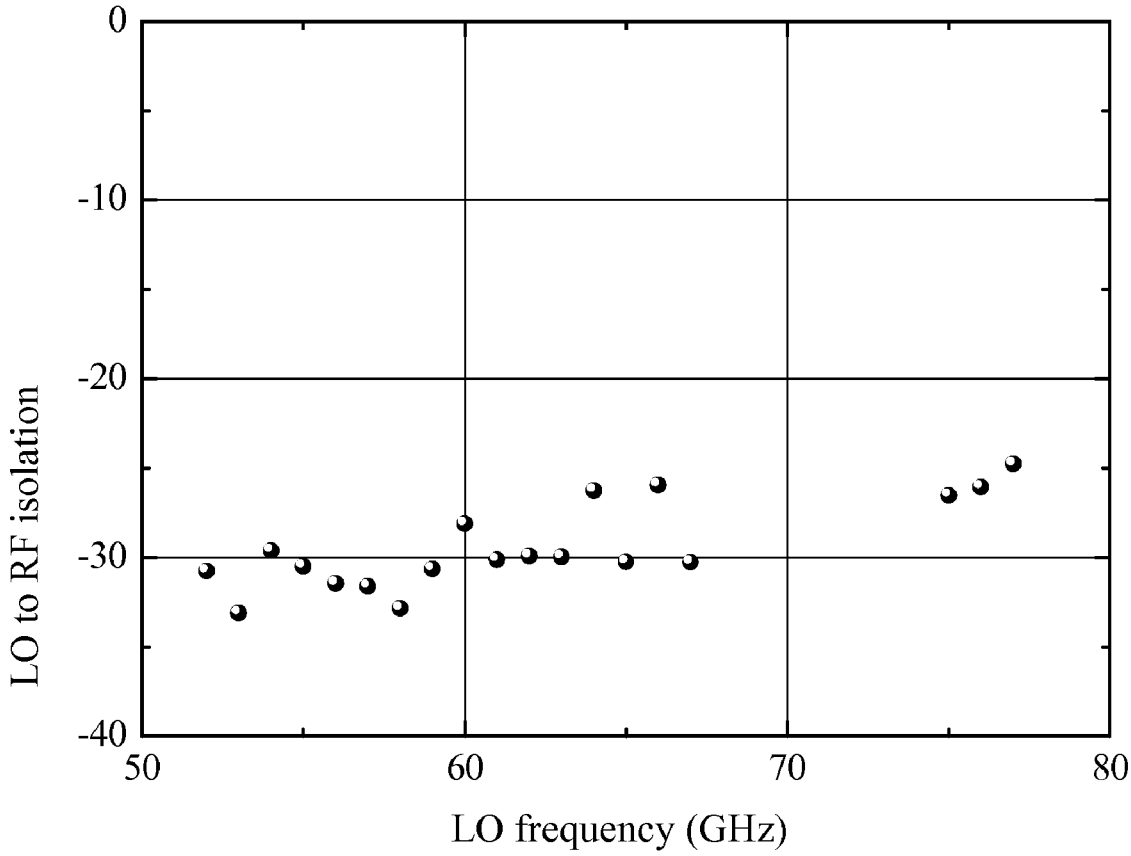
FIG. 9 is a curve diagram showing measurement result of LO-to-RF isolation in a preferred embodiment of the present invention.

FIG. 9 is a curve diagram showing measurement result of the relationship between LO and RF isolation. As shown in FIG. 9, RF isolation is greater than 20 dB within 50 to 78 GHz.

Table 1 is a summary the performances of conventional millimeter-wave passive MMIC mixers. Present invention has a smallest chip size with competitive performance and wide bandwidth.

TABLE 1

| | Frequency (GHz) | Conversion loss (dB) | Design topology | Manufacturing process | Chip size ($mm^2$) |
|---|---|---|---|---|---|
| L. Verweyen et al. (1998) | 75-88 | 6.8-10 | Singly balanced diode mixer | GaAs MESFET | 1.6 × 2.4 |

TABLE 1-continued

| | Frequency (GHz) | Conversion loss (dB) | Design topology | Manufacturing process | Chip size ($mm^2$) |
|---|---|---|---|---|---|
| K. Kamozaki et al. (1997) | 76.6 | 9.5 | Singly balanced diode mixer | 0.15 μm GaAs HEMT | 1.2 × 1.4 |
| T. N. Trinh et al. (1987) | 50-103.5 | 11.6 ± 2.8 | Singly balanced resistive mixer | 0.15 μm GaAs HEMT | 1.2 × 1.2 |
| A. R. Barnes et al. (2002) | 88-100 | 8 | Single-ended resistive mixer | 0.1 μm InP HEMT | 1.175 × 1.1 |
| A. R. Barnes et al. (2002) | 75-105 | 10-12 | Singly balanced resistive mixer | 0.1 μm InP HEMT | 1.8 × 1.1 |
| Y. Mimino et al. (2002) | 52-64 | 12-14 | Singly balanced resistive mixer | 0.15 μm GaAs HEMT | 1.18 × 1.2 |
| H. J. Siweris et al. (2003) | 74-76 | 10 | Single-device balanced mixer | 0.13 μm GaAs HEMT | 0.7 × 0.8 |
| M. Kimishima et al. (2001) | 56-72 | 10.6 | Singly balanced resistive mixer | 0.15 μm GaAs HEMT | 1.8 × 2 |
| M. Kimishima et al. (2001) | 72-84 | 10.6 | Singly balanced resistive mixer | 0.15 μm GaAs HEMT | 1.8 × 2.4 |
| Present invention | 46-78 | 7-10 | Singly balanced diode mixer | 0.15 μm GaAs HEMT | 0.57 × 0.52 |

According to the above description, the Marchand balun of the present invention has following advantages:

(1) the Marchand balun of the present invention has wider operation bandwidth than conventional Marchand balun in the same chip size which allows the present invention to be applied for more different types of systems; or the present invention has smaller size than conventional Marchand balun at the same center frequency which can reduce the manufacturing cost; and (2) the present invention can be applied to MMICs, which conforms to the current industry trend, and the present invention can be applied to chip using silicon substrate in the future, which conforms to the cost reduction strategy.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A Marchand balun comprising:

an edge-coupled-line set including:

a first coupled line electrically coupled to ground;

a second coupled line disposed substantially in parallel to one side of the first coupled line and electrically coupled to ground;

a third coupled line disposed substantially in parallel between the first coupled line and the second coupled line for receiving and processing an input signal; and a plurality of air bridges electrically coupled to the first coupled line and to the second coupled line as transmission lines between the first coupled line and to the second coupled line;

wherein a ratio of a total width of the plurality of air bridges to the length of the first coupled line or the second coupled line is greater than 50%.

2. The Marchand balun as claimed in claim 1, wherein the plurality of air bridges are made of a metallic material.

3. The Marchand balun as claimed in claim 1, wherein the plurality of air bridges are electrically coupled between the first coupled line and the second coupled line for coupling the processed input signal to the second coupled line as a balanced output signal.

4. The Marchand balun as claimed in claim 1, wherein the first coupled line is a parallel edge-coupled line of ¼ wavelength in length.

5. The Marchand balun as claimed in claim 1, wherein the second coupled line is a parallel edge-coupled line of ¼ wavelength in length.

6. The Marchand balun as claimed in claim 1, wherein the third coupled line is a parallel edge-coupled line of ¼ wavelength in length.

7. The Marchand balun as claimed in claim 1, wherein the input signal is a microwave signal.

8. The Marchand balun as claimed in claim 1, wherein the input signal is a millimeter-wave signal.

9. The Marchand balun as claimed in claim 1, wherein the Marchand balun comprises two symmetric sets of said edge-coupled-line sets.

* * * * *